US006120723A

United States Patent [19]

Butler

[11] Patent Number: 6,120,723

[45] **Date of Patent: *Sep. 19, 2000**

[54] FOUNDATION FOOTING CONSTRUCTION METHOD, PARTICULARLY AS SERVE TO EFFICIENTLY PRECISELY EMPLACE WALL ANCHORS

[76] Inventor: Michael G. Butler, 31078 Turner Rd., Fort Bragg, Calif. 95437

[ * ] Notice: This patent issued on a continued prosecution application filed under 37 CFR 1.53(d), and is subject to the twenty year patent term provisions of 35 U.S.C. 154(a)(2).

[21] Appl. No.: 08/831,592

[22] Filed: Apr. 9, 1997

Related U.S. Application Data

[63] Continuation-in-part of application No. 08/600,408, Feb. 12, 1996, Pat. No. 5,830,378, which is a continuation-in-part of application No. 08/398,356, Mar. 3, 1995, abandoned, which is a continuation-in-part of application No. 08/299,474, Aug. 29, 1994, Pat. No. 5,564,235.

[60] Provisional application No. 60/015,159, Apr. 10, 1996.

[51] Int. Cl.[7] ..... E04B 5/17

[52] U.S. Cl. ..... 264/333; 52/293.3; 52/295; 249/34; 249/93; 249/97

[58] Field of Search ..... 249/34, 91, 93, 249/97, 3; 52/293.3, 295, 699; 264/333

[56] References Cited

U.S. PATENT DOCUMENTS

| | | | |
|---|---|---|---|
| 2,490,228 | 12/1949 | Pontiere | 249/34 |
| 3,207,465 | 9/1965 | Papin | 249/34 |
| 3,397,494 | 8/1968 | Waring . | |
| 3,797,800 | 3/1974 | Loy | 249/34 |
| 4,202,145 | 5/1980 | Coulter et al. . | |
| 4,533,112 | 8/1985 | Santos, Jr. et al. . | |
| 5,240,224 | 8/1993 | Adams | 249/93 |
| 5,343,667 | 9/1994 | Peden | 52/699 |
| 5,399,050 | 3/1995 | Jacobus | 249/34 |

*Primary Examiner*—Harold Pyon
*Assistant Examiner*—Joseph Leyson
*Attorney, Agent, or Firm*—Fuess & Davidenas

[57] ABSTRACT

A concrete footing for the construction of a wall is created by the placement of a guide member with a series of very large holes, which is supported with adjustable threaded stake supports. This guide is situated along a location which will become the top surface of that footing, typically within the confines of a footing trench. Concrete is conventionally placed via a pump through the large holes thus filling the trench void up to the guide element underside. Adjacent guides are attached with plastic connectors which also fixture vertical reinforcing elements which disassemble to strip guides, typically immediately after concrete has been placed.

18 Claims, 6 Drawing Sheets

FOUNDATION FOOTING CONSTRUCTION METHOD, PARTICULARLY AS SERVE TO EFFICIENTLY PRECISELY EMPLACE WALL ANCHORS

REFERENCE TO RELATED PATENT APPLICATIONS

The present patent application claims the benefit of U.S. Provisional Application No. 60/015,159 filed on Apr. 10, 1996.

The present patent application is a continuation-in-part of U.S. patent application Ser. No. 08/600,408 filed on Feb. 12, 1996, now U.S. Pat. No. 5,830,378, which is a continuation-in-part of U.S. patent application Ser. No. 08/398,356 filed on Mar. 3, 1995, now abandoned, which is a continuation-in-part of U.S. patent application Ser. No. 08/299,474 filed on Aug. 29, 1994, now U.S. Pat. No. 5,564,235.

The present patent application is related to U.S. patent application Ser. No. 08/831,591 filed on Apr. 9, 1997 and to U.S. patent application Ser. No. 08/818,497 filed on Mar. 14, 1997, now abandoned. All related predecessor applications are to the selfsame Michael Butler who is the inventor of the present application.

The contents of the related predecessor provisional, and copending utility, patent applications are incorporated herein by reference.

BACKGROUND OF THE INVENTION

1. Field of the Invention

The present invention generally concerns methods and devices for the construction upon the surface of the earth of cast in-situ concrete footings which footings serve as support for subsequently built foundation walls, and the like.

The present invention particularly concerns fixtures that efficiently define the top surfaces and the edges of cast in-situ concrete footings, and that accurately locate cast-in-place elements which cooperate structurally with subsequently superimposed walls, which walls can be constructed from any of solid concrete, grouted building blocks of cement-masonry or foam units, shot-creted insulated panels, et cetera.

2. Description of Prior Art 2.1 General Background

Traditionally built footings for cement masonry unit (CMU) foundation walls are made of cast in-situ concrete, often having a top surface defined only by string lines and manual tooling (except in the case of basement construction, where the footing is traditionally formed with boards). Usually this footing will have resulting corners and steps which do not correspond with the desired accuracy to the pre-determined CMU modular units. Also, vertical reinforcing stub-ups are frequently misplaced. Thus, a lot of time is wasted in the construction of the subsequent CMU wall in dealing with these irregularities.

Experienced tradesmen will frequently set the first course of block while the concrete of the footing is still wet, thus verifying block modular layout, et cetera, before the footing concrete has set. Unfortunately many situations do not easily permit use of this method, such as where sloping sites require many steps in the footing, or where pre-situated (before footing concrete placement) vertical reinforcing steel (rebar) is required by building (seismic) codes. With the vertical rebars pre-located, the presence of the pre-location fixtures, as well as the rebars themselves, cause difficulty in placing the block onto wet footing concrete, regardless of any presence of steps, eat cetera.

Where fixtures must be erected to locate pre-situated vertical reinforcing steel, much labor is consumed in situating the fixture and in laying out the vertical rebars. Most building jurisdictions in seismically active areas require that these Laborious steps be taken, despite the resistance from the building trades, because it is the only way to be sure that the foundation wall reinforcing will be placed properly, and where it is most needed.

Foam building-block products are generally set on formed footings of cured concrete, and this concrete does not necessarily have a trued top surface. The light weight of the foam causes a buoyant effect as grout is placed. Because of these factors, a sacrificial 2×4 wood keeper is usually (powder-actuated) nailed to the footing concrete on either side of the first course of foam block, in order to prevent (otherwise frequent) grout blow-outs at the bottom of the foam block build-up.

Thus to such extent as foam block methods are used for construction of basements, the layout of foundation walls (in the horizontal plane) is undertaken three times in three distinct operations. First, foundation layout is undertaken in setting the footing forms. Second, foundation layout is undertaken more accurately locating block modules for vertical reinforcing and turning point placement, etc. And third, foundation layout is undertaken in setting the 2×4 keepers at either side of the blocks.

Other proprietary in-situ concrete wall construction methods use welded wire mesh panels (WWMP), which typically incorporate built-in foam insulation panels. The panels are set in place contiguously and are typically covered with in-situ concrete via pneumatic methods (shotcrete), or else with conventional concrete and wall forms. The WWMP panel walls usually have thin "wythes" of concrete requiring very accurate placement of an increased number of footing vertical rebars. Many difficulties result in placement of WWMP's. Code-required concrete cover over reinforcing steel can not be achieved if these vertical stub-ups are not very accurately placed. Carefully built fixtures for this purpose are essential.

2.2 Specific Prior Art

The most relevant prior art relating to this and related co-pending applications is believed to be that disclosed in U.S. Pat. No. 3,397,494 to Waring, issued Aug. 20, 1968. In the method of Waring a perimeter member is supported in place by machine-threaded rods in order to form a special recessed ledge about a concrete slab (for a proprietary wall system). These rods thread into bearing pads that sit upon the earth, and then provide vertical adjustment to the perimeter member. No allowance is provided for rod location. It must be directly at a member (normal bolt-sized) hole, regardless of what local anomaly or rock might be at that location.

The amount of buoyant force which would be generated by properly placing concrete against the underside of the perimeter section shown does not appear to be addressed by the Waring support method. The Waring rod supports offer little resistance to uplift because they are of normal machine thread, which is too fine and slight to have a capability of effectively threading into the earth for anchorage.

Horizontal adjustment and lateral stability are not accomplished by the Waring Method, and so a substantial redundant perimeter forming method of wood members is shown to be necessary with these adjustable vertical support methods.

2.3 Objectives

Accordingly, it would be useful if some method for the construction of poured concrete footers could really serve as a starting point for the construction of walls, directly above the earth, with a minimum of effort.

The method would desirably permit easy and accurate pre-location of any structural elements necessary for the construction of the wall, all with a minimum of skill.

Modular increments specific to a given construction module would desirably be pre-located—where such increments must be known for steps and turns in the wall—with a minimum of effort and skill.

Low-cost rigid-element fixtures would desirably force all the planes of construction, all reinforcing elements, all steps, and all turns into the proper locations for diverse specific wall construction methods.

SUMMARY OF THE INVENTION

The present invention contemplates low-effort, low-skill, low-cost methods and devices for the construction of footers for walls which footers are placed directly upon the surface of the earth, particularly as the footers efficiently incorporate precisely emplaced wall anchors. The footers are of such high quality that they are suitable starting point for the accurate location and construction of diverse walls.

The construction of the quality footers is realized by accurate pre-location of all structural elements necessary for the construction of that wall. The accurate location transpires with a minimum of skill, involving low-cost rigid-element fixtures that force the planes of construction, and the locations of all reinforcing elements and steps and turns, into the precise proper locations for any specific wall construction method.

The easy and accurate location of the rigid-element fixtures is particularly promoted by the use screw-stakes (with additional simple components) that both (i) stake into earth and (ii) provide adjustment in all directions after staking. These stakes (and accompanying components) permit rigid structural elements to be easily both (i) staked into place, and (ii) spatially adjusted in position to high accuracy, as necessary.

Furthermore, regular and repeated location of objects, such as wall anchors, by use of fixtures is accomplished by a repeating pattern in the rigid elements. The repeating pattern serves to locate rebars, steps, and turns in footings, et cetera. Adjacent rigid elements are brought in sync with established repeating patterns by simple overlap and pattern mesh operations.

1. Starting the Construction of a Wall

In its principle aspects, the present invention is embodied in a method and a system for starting the construction of a wall upon the surface of the earth.

The method involves suspending above the surface of the earth a fixture that serves to define where a top surface and top edges of a footer would desirably be located. Flowable hardenable construction material is then placed upon the surface of the earth beneath and up to the underside of the suspended fixture. When the construction material hardens a footer for a wall is thus created. This footer has a top surface and top edges which have been defined by the fixture. Needless to say, if the fixture is very accurately made from, for example, construction steel then the footer is also very accurate.

The method suspending is preferably realized by holding aloof the fixture with threaded stakes driven into the earth.

The placing is typically of concrete under pressure.

Similarly, the present invention is embodied in a system for defining a starting point for a construction of a wall. The system includes (ii) a metal fixture suitable in its underside contours to define a top and top edges of a footer of flowable construction material, and (ii) a means for supporting the fixture suspended above the surface of the earth. When flowable hardenable material is readily placed upon the earth up to the underside of said fixture under pressure, and will harden to produce a footer for a wall the top surface and top edges of which footer have been defined by the fixture.

The supporting means most commonly comprises threaded stakes driven into the surface of the earth.

The system's metal fixture is typically suitable in its underside contours to define any of a foundation wall, a sound wall, a privacy wall, a building wall, a garden wall, a retaining wall, and still other walls.

The system's fixture is most commonly actually a plurality of nesting fixtures that overlap to permit extended length. The system's fixture may also, or alternatively, be telescoping, whereby length cutting can be omitted even within the confines of defining a footer of particular geometry.

The fixture preferably has and defines a repeating pattern of holes for attaching adjacent structural elements, most commonly foundation anchors and/or rebar. The fixture's repeating pattern of holes thus generally serve to define a geometry that matches a geometry of construction modules of a wall that is subsequently built upon the footer. These construction modules include (i) cement or concrete masonry units (CMU's) particularly including cement or concrete blocks, (ii) foam building blocks, and (iii) welded wire mesh panels.

2. A Foundation Footer-with-wall-anchors Forming System

In another of its aspects, the present invention may be considered to be embodied in a foundation footer-with-wall-anchors forming system.

The system includes a number of elongates linear precision guide members that are suitably lightweight so as to be suspended level above the surface of the earth, overlapped and abutted where necessary, so as to form the precision outline of a foundation. Each guide member has (i) an number of relatively larger holes through which flowable building material may suitably be placed, and (ii) an arrayed multiplicity of relatively smaller holes at a precise spacing both along the linear extent of the member and transverse to this extent.

The system also includes a number wall anchors suitably strong to anchor a wall to a hardened foundation footer when appropriately positioned partially within the foundation footer while extending above the footer.

Finally, the system includes a number of plugs each having a central bore and complimentary in size so as to suitably be placed in any of the relatively smaller holes of the guide members. Certain plugs are selectively so placed in selected relatively smaller holes of the guide members in order to (i) precision-align overlapped guide members in the regions of their overlap while in their suspended state, therein to establish a regular geometry among and between guide members, and, separately, in order to (ii) hold within their central bores wall anchors suspended both downhanging into the void below the suspended guide members and extending into space above the suspended guide members.

By this system a foundation footer of flowable construction material may be placed beneath the guide members, including when required by passage through the relatively larger holes of the suspended guide members. When this flowable construction material subsequently hardens the wall anchors are not only left anchored in the hardened flowable construction material, but they are left precisely spatially positioned in accordance with the precision geometry of both the guide members, and the guide members as were precision aligned.

3. A Method of Constructing a Foundation Footer

In another of its aspects, the present invention may be considered to be embodied in a method of constructing a foundation footer.

In the method a number of elongate linear guide members are suspended level above the surface of the earth in the rough outline of a foundation footer. Each guide member has an arrayed multiplicity of holes at a precise spacing both along the linear extent of the member and transverse to this extent, and (ii) side flanges. By this construction the guide members are suitably both (i) overlapped at their end regions to extend straight for a greater distance than is a length of a single member, and (ii) abutted at right angles where a foundation footer corner is desired to be located.

Elongate linear spanning members, relatively much shorter than are the guide members and having arrayed small holes of equal size and on equal dimensions as are the holes of the guide members, are placed in positions overlying abutting guide members.

The guide members and spanning members in their suspended state are precision-aligned by placing plugs within at least some of the arrayed multiplicity of holes in the regions of overlap between guide members and spanning members, and between guide members and spanning members. All linear dimensions of all suspended members are thus brought into tight dimensional tolerance in accordance with the precision of the spacing of the holes.

The precision-aligned guide and spanning members are then trued to right angles, making that the suspended members that are in tight dimensional tolerance in the outline of a foundation are also in precise relative locations and angular relationships.

Flowable building material is then placed beneath the suspended precision-aligned trued guide and spanning members to produce when hardened a foundation footer.

At least some of the guide members and spacing members and plugs may subsequently be stripped from off the hardened foundation footer for re-use.

3. A Plug Assembly

In yet another of its aspects, the present invention may be considered to be embodied in a plug assembly cooperatively interactive with (i) a member, having and presenting a hole, that is positioned above a location where a foundation footer is desired to be placed, and (ii) a foundation anchor. The cooperative interaction between the plug assembly and the holed member and the foundation anchor is such that the foundation anchor may become emplaced within the foundation footer below the position of the member's hole and upstanding thereat so as to serve as an attachment for wall.

The plug assembly includes a body that is longitudinally split to expose a central bore where is positioned the foundation anchor. The base of the body is of complimentary shape and size to the hole of the member so as to be inserted into position therein and thereafter to resist further rotation, the split portions acting with a clamshell action to close and to engage and to embrace the foundation anchor. The insertion is normally by plunging a plug assembly of elastomeric material into the hole, the plug assembly having outward-splayed claw feet, and preferably two such feet in spaced-parallel vertical planes, which serve to engage the member at its hole of complimentary size and shape.

The plug assembly body normally separates into two halves, and is substantially frustaconical in shape with, preferably, an exterior double helical thread.

A hollow frustaconical cover, or shell, also possessing at its interior surface a double helical thread may be (i) slid along a positioned foundation anchor so as to be (ii) fitted by screwing over the top of a closed plug assembly body, holding the body closed with the foundation anchor snugly firmly frictionally maintained therein.

4. Context

The present invention accordingly uses a number of unique items—including (i) stakes, and (ii) a space frame, or fixture, and (iii) plugs—in an overall system, and method for the fast and efficient creation of a footer. The method of the present invention using as it does a rigid-element fixture is made particularly effective by the use of the screw-stakes which, with their accompanying simple components, permit extremely rapid, easy and accurate location and precision adjustment in all directions after staking of the space frame (the suspended fixture). The present invention thus permits that rigid structural elements are easily both (i) staked into place and (ii) subsequently adjusted to high accuracy, as necessary.

Regular repeated object location is accomplished by use of fixtures having a repeating pattern in these rigid elements, the rigid elements serving to locates rebars, steps, and turns in footings, et cetera. Adjacent rigid elements are brought in sync with established repeating patterns by a simple overlap and mesh of pattern.

These and still other aspects and attributes of the present invention will become increasingly clear upon reference to the following drawings and accompanying specification.

DESCRIPTION OF THE PREFERRED EMBODIMENT

2. Detailed Description

Figure 1:
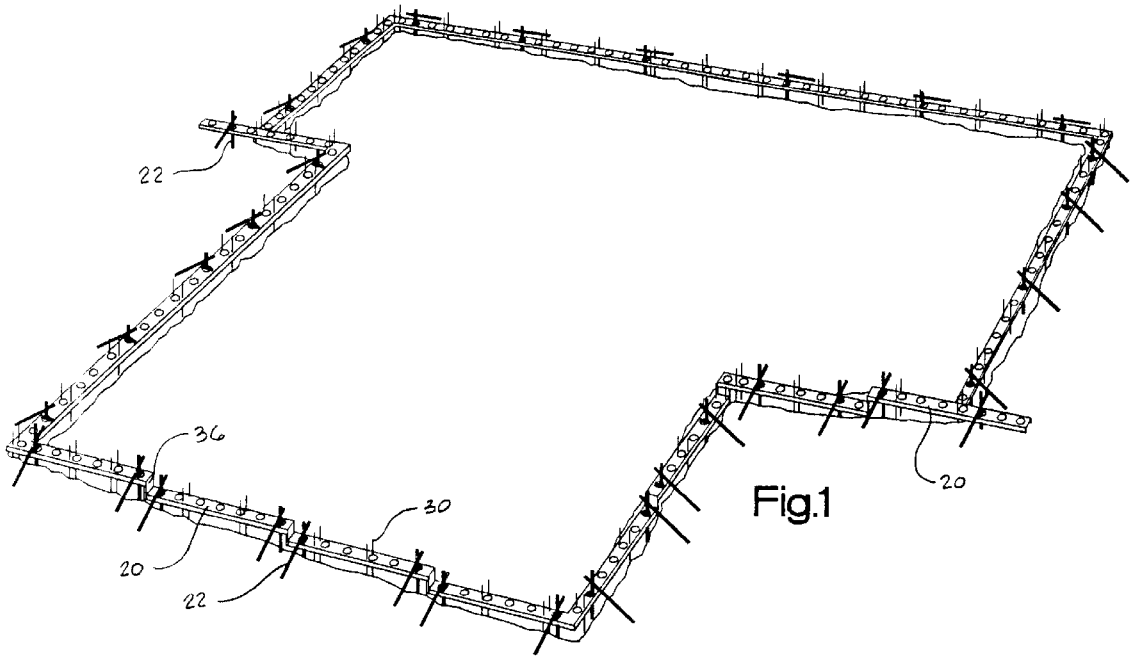
FIG. 1 is a perspective view showing a foundation perimeter in accordance with the present invention under construction, with guide tracks staked in place ready for placement of footing in-situ concrete.

Beginning in the drawings FIG. 1, a perimeter to a building foundation on a sloping site has been trenched for placement of in-situ concrete footings which will support subsequent foundation walls. The starting point of these walls, linear horizontal segments, has been defined by lengths of a guide track 20. Each length of guide track 20 is supported in place by sets of a threaded stake 22, in conjunction with other hardware described below. Track 20 in turn supports vertical lengths of a reinforcing bar 30 which are typically required to bond any subsequent foundation wall which is of a cast in-situ structure.

To both accommodate the site slopes and ideally the modular increments of a particular foundation wall construction, lengths of guide track are stepped vertically to create ordered straight level segments for subsequent wall construction, and are physically connected at those steps by an element described below. Since this method is primarily the starting point for subsequent foundation walls, it is best kept close to the ground to avoid concrete forming efforts, and the stepping methods allow this close correspondence to grades. Where the site is level the adjacent lengths of track 20 are interconnected by overlap.

Figure 2:
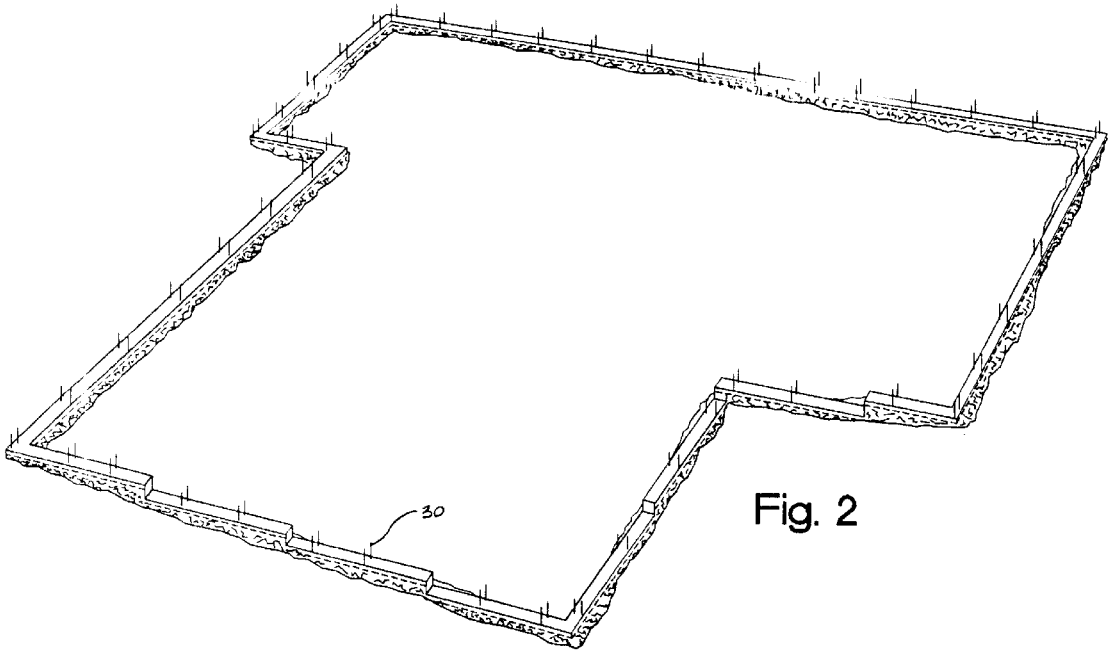
FIG. 2 is another perspective view of the same foundation perimeter shown in FIG. 1, now after the guide tracks have been removed and the footing concrete has set, ready for foundation wall construction.

FIG. 2 shows the appearance of the concrete footings after guide tracks 20 and supporting hardware elements have been removed. The rebars 30 remain as required for the structure of the foundation walls.

Figures 3, 4:
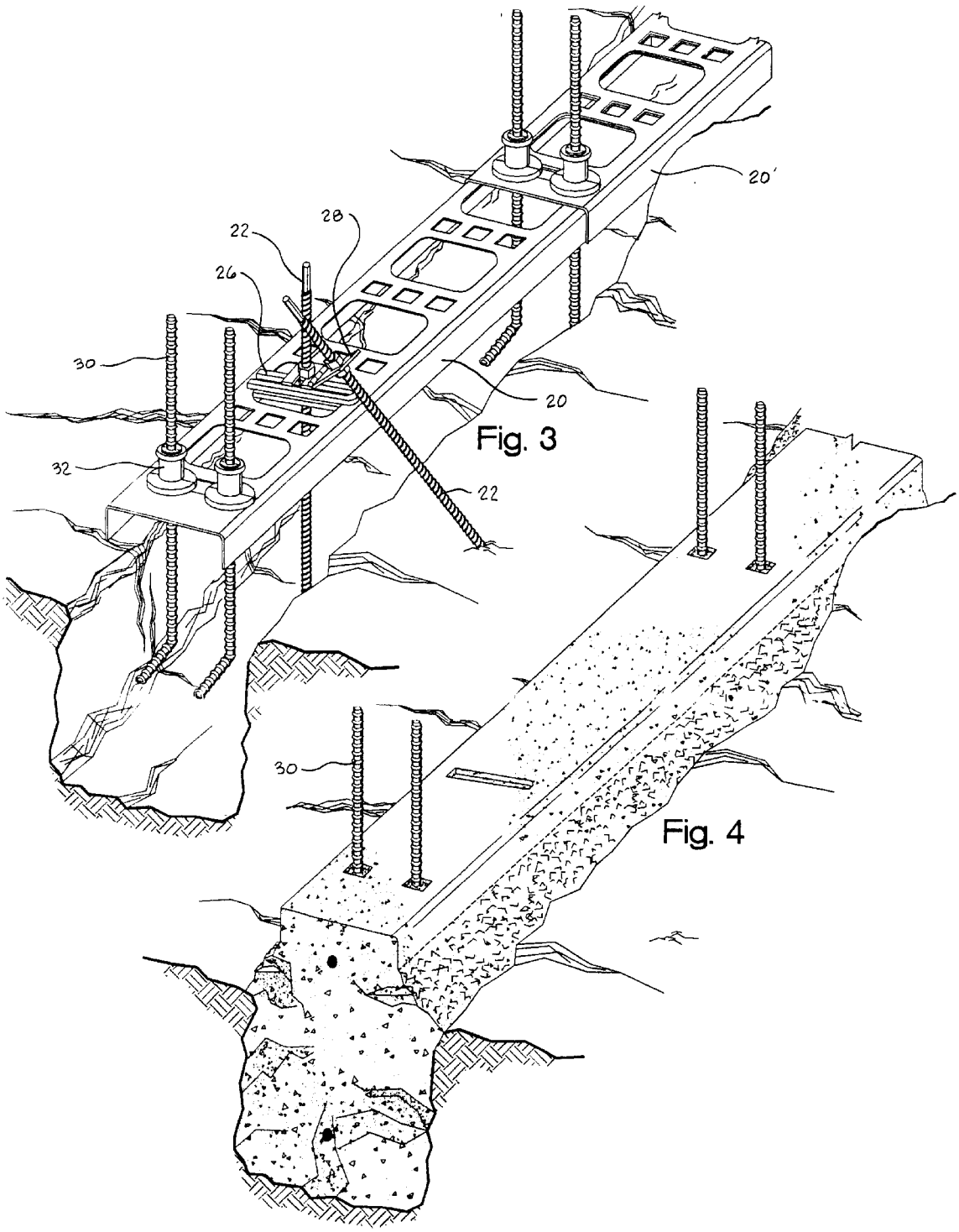
FIG. 3 is a detail perspective view showing a portion of guide track, ready for concrete placement, as was seen in FIG. 1.
FIG. 4 is a detail perspective view showing the portion of the foundation perimeter shaped with the guide track in FIG. 3.

FIG. 3 shows detail of adjacent guide tracks 20 with one set of supporting hardware.

Track 20 can be of any dimension which suits particular requirements. For most situations, lengths of about 3.162 M (10') are suitable, and this corresponds to the length of most press brakes utilized in folding these type of parts. Track in use so far is press braked of 1.18 mm (14 gage) cold formed steel, and alternatively could be of about 3 mm extruded aluminum type 6061-T6, or the like.

Track width is to suit dimensional needs of the subsequent wall. A nominal width of 200 mm (8") inside diameter suits common block wall products. For any nominal width, track can more beneficially be made in nesting pairs, so that both adjacent track connection overlap and length adjustment by telescoping action are possible. Thus outer nesting track 20' is of an inside diameter wide enough to accommodate the outside diameter of track 20 with sliding clearances.

To aid in linearity of construction, significant overlap can be made with adjoining tracks, thereby extending linearity. For this purpose, 3.05 M (10') tracks can be repeated at 2.44 m (8') on center, leaving 0.61 M (2') overlap, for example. Any guide track dimensions and overlap can be established to suit particular circumstances and subsequent wall construction methods.

The width of projecting flanges should be at least 50 mm (2") for member stiffness. It is important that track remain straight in the horizontal plane in that its purpose is to create a true cast concrete surface.

The pattern of holes shown in track 20 is one which provides a series of relatively large access openings, of at least about 88 mm (3½") along by about 150 mm (6") across a 200 mm (8") wide track 20, for the placement of concrete, described below. Track 20 also has an interspersed series of smaller openings, 38 mm by 38 mm 1.5 (1½"×1½"), three across, which provide for attachment of fixtures described below. There is no absolute need for this particular pattern shown, and in fact many different proprietary foundation wall systems could have their own needs for other specific hole patterns. In the experience of the inventor this particular pattern offers good flexibility in rebar 30 placement, adjacent track interconnecting, described below. A requirement of any pattern is to minimize horizontal surface area which hinders concrete placement and air void removal, and to center the smaller holes where rebar will be required for subsequent wall construction.

The regular spacings of the hole patterns best corresponds to the modular units used in construction of the subsequent foundation wall. The choice of a three across pattern of the reinforcing bar locating holes is to permit centered, offset, or paired rebar placement at any modular increment.

Threaded stake 22 is a coarsely threaded rod having a tapered tip and a hex head. Stake 22 is described more thoroughly in this inventor's U.S. Pat. No. 5,564,235 and patent application Ser. No. 08/600,408. Stakes can be any usable length and diameter. For this method we have been manufacturing them out of 12 mm (½") diameter mild steel coil rod stock.

The vertical stake 22 has at least two nuts which are tightened about two of a clamp bar 26. One bar 26, is below and one is above the plane of track 20. Bar 26 is of about 9 mm by 18 mm (⅜"×¾") mild steel stock for 200 mm (8") wide track, bent into a hairpin shape about the weak axis so that the clearance between the adjacent legs will pass stake 22 without binding, but not so sloppy that a washer would be required under a nut. The length of bar 26 must be such that it will span over the large openings of track 20 for attachment purposes, but will also pass through that same opening when rotated diagonally to the axis, of track 20.

A kicker hinge 28 is a heavy duty hinge with a slot in each leg, as described in this inventor's U.S. Pat. No. 5,564,235 and patent application Ser. No. 08/600,408. A standard door hinge, cut in two perpendicularly to the pin axis, and slotted parallel to the hinge axis for access of the stake 22, will do. Hinge 28 can be clamped directly to bar 26 as shown, or it can be clamped to stake 22 at another height with a pair of nuts. The purpose of hinge 28 is to tie the vertical stake to the sloped stake for lateral support to this track supporting system.

Each vertical length of rebar 30 is held in place by a rebar plug 32, described below, which removes with track 20, leaving the rebar in place as shown in FIG. 4.

Figures 5, 6:
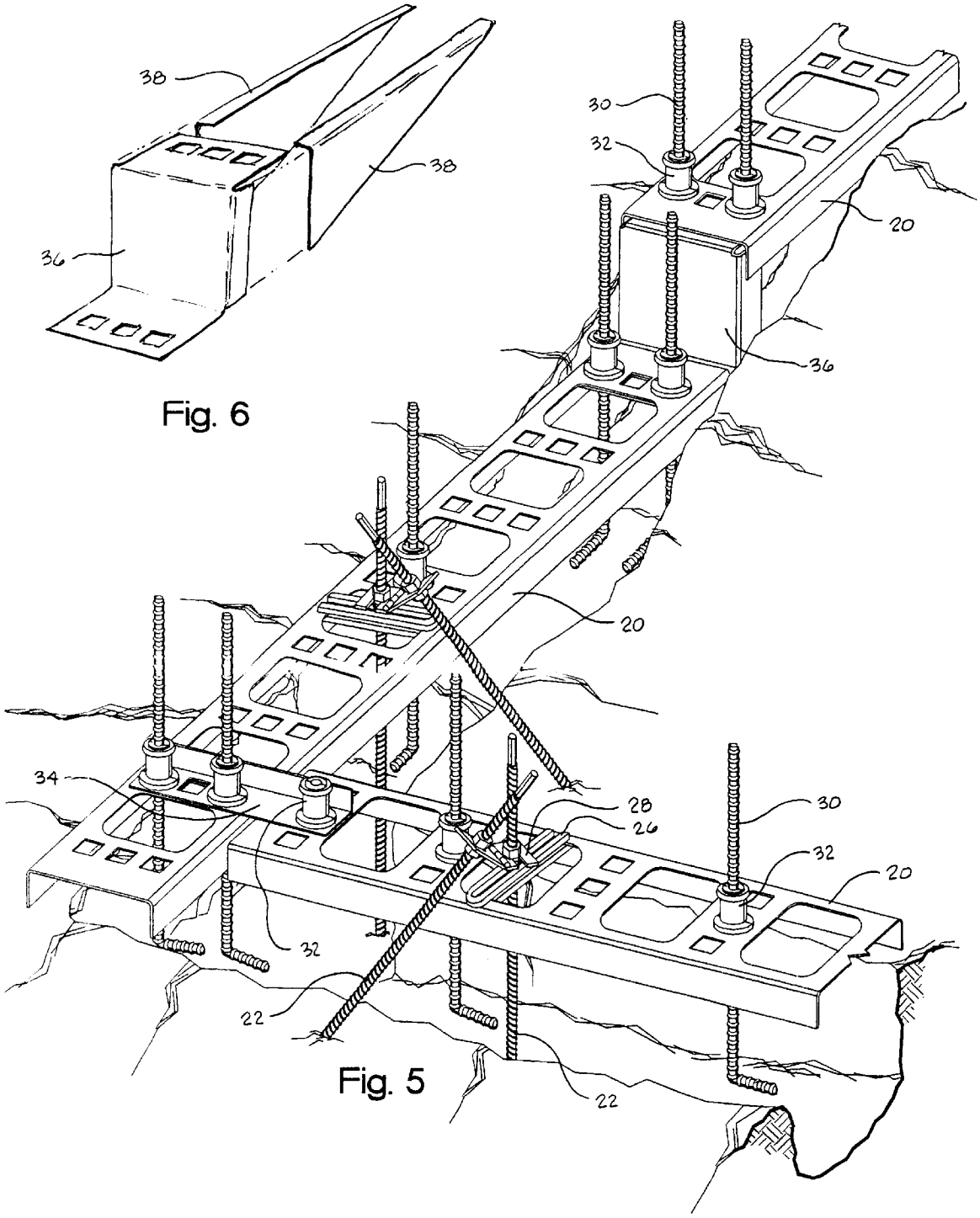
FIG. 5 is a detail perspective view of portions of guide track showing connections at turns and steps.
FIG. 6 is a detail perspective view of a step and step forms.

FIG. 5 shows detail of the linkages between tracks 20. A link 34 provides for definition of a corner while keeping modular dimension consistency by use of properly placed connecting holes. Link 34 can have a stiffening vertical flange, but it is not necessary. This Figure shows use of rebar plug 32 as a connector only, as well as a combination connector and rebar holder. Also this view shows rebar placed on center and two across the wall.

A step 36 connects to track with rebar plugs. It forces the adjacent tracks to desired vertical module while maintaining consistent horizontal modular spacing.

Figure 8A:
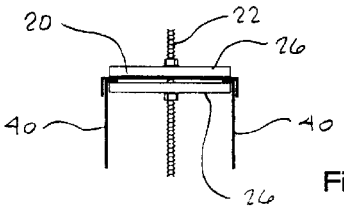
FIG. 8A is a detail sectional view of a guide track with "miniforms".

FIG. 6 shows detail of step 36, which is of at least 1.44 mm (16 gage) cold formed steel, or equivalent. The top and bottom flanges have holes corresponding to track holes, and flanges of dimension allowing this. The side flanges are preferably of at least 25 mm width, so that a step form 38 can be held in place while under forming pressure. Step form is optional, but would typically be necessary where the step occurs above, rather than proximate to or within, the confines of a trench. Step form is also of at least 1.44 mm (16 gage) cold formed steel, and has a top flange of a dimension allowing clamp bar 26 attachment to track (as shown in FIG. 8A). Stem form 38 is preferably of a triangular shape similar to the small mass of concrete needing side forming, and its square corner can be used to establish perpendicularity of step 36.

Figure 7A:
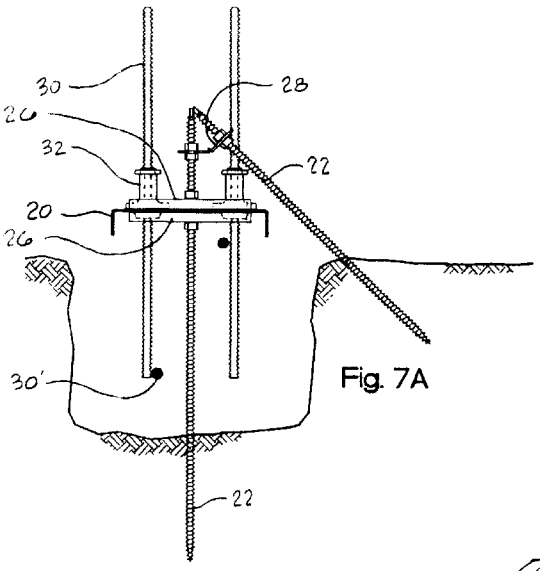
FIG. 7A is a detail perspective view of a section of guide track, flanges down.
Figure 7B:
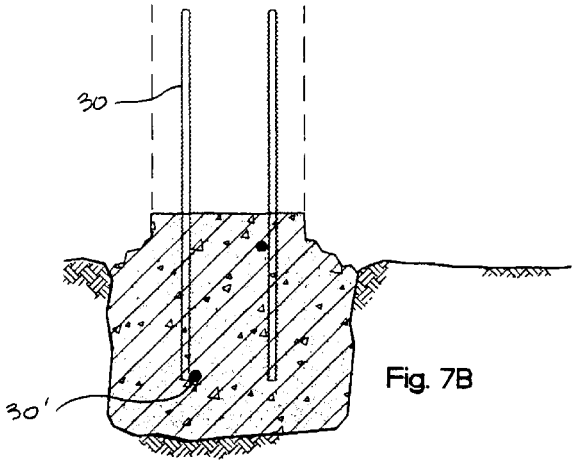
FIG. 7B is a detail sectional view of that subsequent footing.

FIG. 7A shows a section view of typical guide track 20 and related fixtures as previously described. FIG. 7B shows a section of the concrete footing resulting with that orientation of guide track.

FIG. 8A shows the same orientation of guide track also having a mini form 40 on either side, nested inside of track flanges, and clamped to track 20 with clamp bars 26. Mini form is about 1.81 mm (14 gage) cold formed steel or equivalent, has an upper flange of about 25 mm allowing this clamped attachment, and can be of any desired length. Mini form is used similarly to step form when guide track is above rather than proximate to or within a trench, and concrete must be contained. Mini form may substitute for step form. The height of mini form is limited by the forming pressures, and is explained in the operation of this invention below.

Figure 8B:
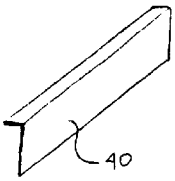
FIG. 8B is a detail sectional view of that subsequent footing.
Figure 8B:
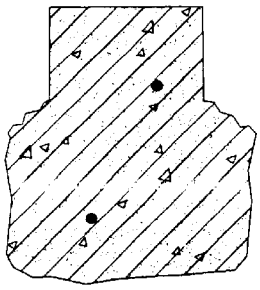

The section of a footing resulting with tile use of mini form is shown in FIG. 8B.

Figure 9A:
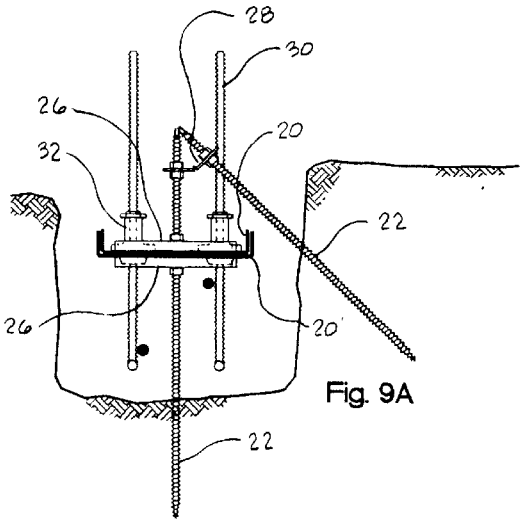
FIG. 9A is a detail sectional view of nested guide track, flanges up.

FIG. 9A shows guide track oriented with flanges up, and with nesting pairs of track being utilized. The remaining arrangement of fixtures is as previously described. Where track is situated within the confines of a trench (or footing form system), the ability to nest allows for track to telescope to a length fitting within most any trench length, avoiding the need to cut track members.

Figure 9B:
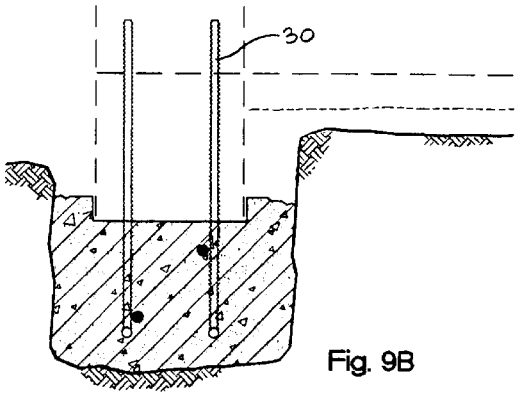
FIG. 9B is a detail sectional view of that subsequent footing.
Figure 10A:
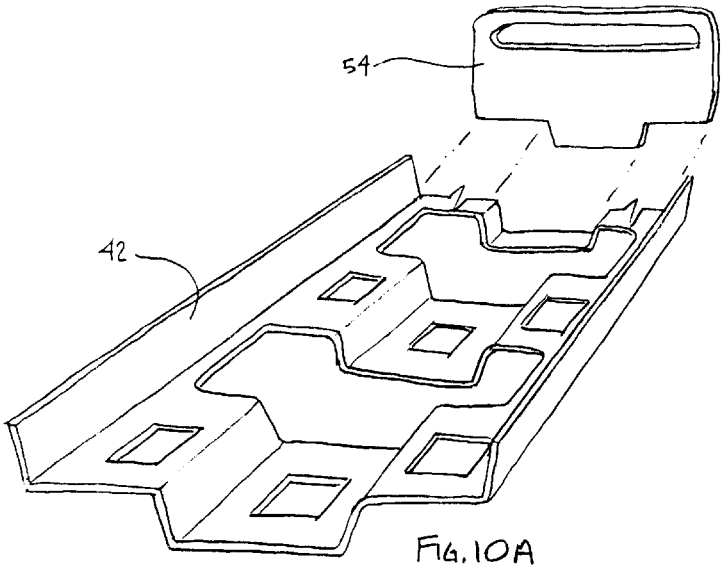
FIG. 10A is a detail view of key way guide track, flange up version.

FIG. 9B shows a footing resulting from the flange up orientation of track (where a screeding tool such as is shown in FIG. 10A is used). This resulting recessed channel provides for physical confinement as well as location of subsequent walls, avoiding the need to subsequently attach keeper members as many wall forming systems require. This channel also serves as a key way for in-situ solid concrete foundation walls.

Figure 10B:
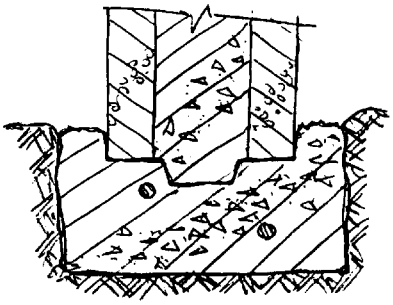
FIG. 10B is a detail sectional view of that subsequent footing with a grouted foam-block wall above.

FIG. 10A shows a key way guide track with flange up orientation 42, and a corresponding screed tool 54. Tool 54 can be made from plywood. The additional two folds in this track 42 section create a footing as shown in section in FIG. 10B. A center key way channel is created as well as a fill width channel, so that physical confinement of a wall forming system such as foam block is present, and a structural confinement is created by the presence of the center channel when the subsequent wall grout or concrete is placed.

Figure 11A:
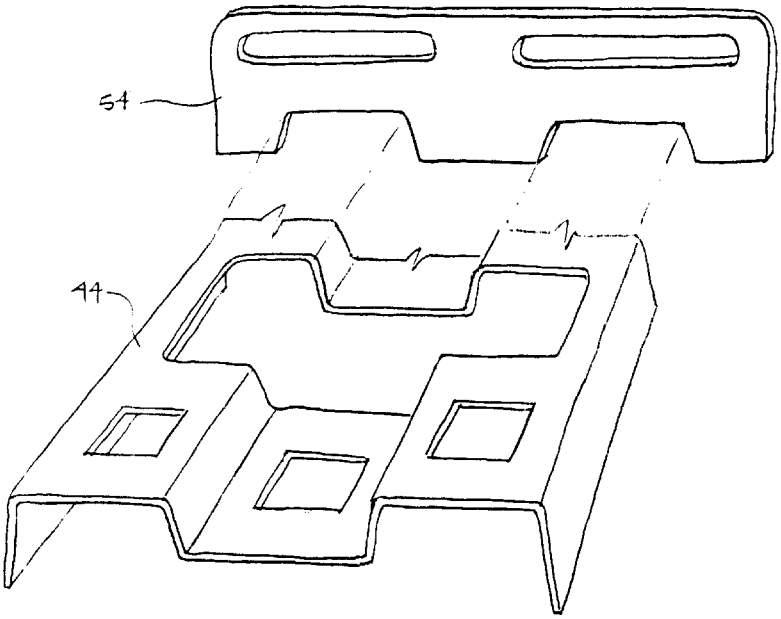
FIG. 11A is a detail sectional view of key way guide track, flange down version.
Figure 11B:
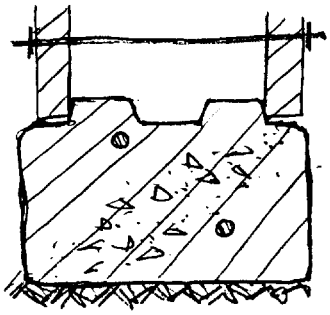
FIG. 11B is a detail sectional view of that subsequent footing with foundation wall forms in place.

FIG. 11A shows a key way guide track with flange down orientation 44, and the corresponding screed tool 54'. This version of track provides a structural key way while providing shoulders for the location of a traditional wall forming system, as shown in FIG. 11B.

For both the key way tracks the nesting can be provided by sloping the flange elements as necessary to nest adjacent tracks, since the confined edges of the key way must be sloped to strip the track from hardened concrete, where it is left overnight, et cetera. The slope for the sides of the key way must be of about 16 degrees from the perpendicular for the nesting, depending somewhat upon the track thickness. The edge flanges can slope at a few less degrees because they are not confined. This slope provides some beneficial taper to aid the setting of subsequent wall forming elements.

Figure 12:
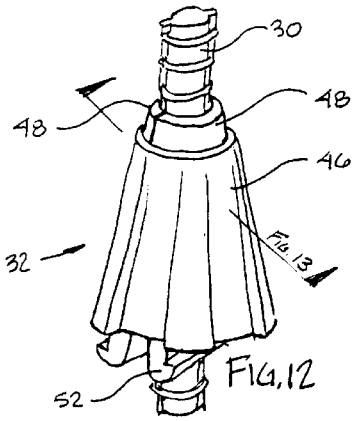
FIG. 12 is a detail sectional view of a rebar plug, with the guide track omitted for clarity.

FIG. 12 shows rebar plug 32 in place about a length of rebar 30. The guide track 20 is omitted for clarity. Two of an identical half-shell 48 are encapsulated by a cover 46. These three elements making up the rebar plug are all best of high density polyethylene plastic formed by injection molding. The details of this molding process is not delved into here. Prototype rebar plugs have been made with two part room temperature vulcanizing polyurethane plastics formulated to imitate high density polyethylene. In any case, the plastic strength and thicknesses must be appropriate for the described usage. The overall height of plug should be at least about 100 mm (4") for manual operation and strength requirements. Prototype plugs have been manufactured to function in 38 mm (1½") square holes, but this can vary to suit.

Figure 13:
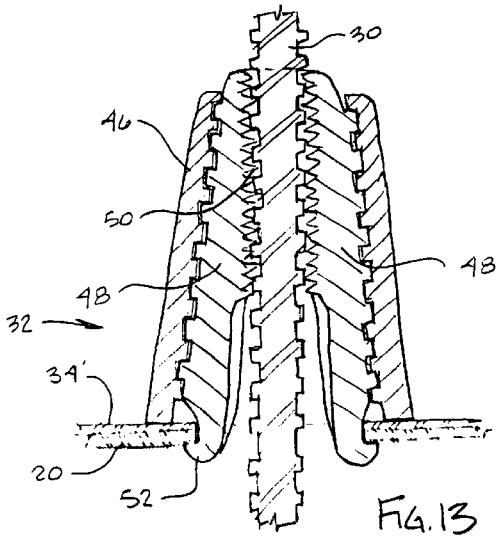
FIG. 13 is a detail sectional view of a rebar plug.

FIG. 13 is a section right through the center plane of rebar plug 32. Each half-shell 48 is sized to correspond with a given rebar 30 diameter, in that the feelers 50 are of a dimension to provide pressure to rebar outer deformations as each half shell 48 is fully engaged by cover 46, thus holding rebar securely in place. The vertical extent of feelers 50 should be at least about 63 mm (2½") to provide enough stability to rebar. The feelers can be a of surface similar to machine threads, but exaggerated at least 50% in projection, and they should have vertical breaks allowing more flexibility. Rebar is not at all consistent in effective diameter. so flexibility is necessary to accommodate the variations.

At the bottom of each half shell 48 is a hook foot 52 which serves to anchor plug 32 to track 20 as cover 46 is fully engaged. The curvature of the foot bottom must be such that half-shell 48 can rotate out of hardened concrete until the hook ledge itself clears the edge of track 20 hole opening. In other words, below the track, increasing curvature is preferable as hook bottom surface gets closer to the hook ledge itself. Thus the hook ledge must be of a lessor dimension than the hook thickness in the plane of the track. The outer surface of the half-shell above the hook ledge continues vertically for enough distance to allow plug to accommodate from one to three plies of guide track, step flange, link, et cetera, as would be required. The dimensional requirements of the hook are the primary consideration in the choices of strength and stiffness of half-shell plastic. The correspondence to a particular hole size is of course very important, and should be kept standard so that hooks do not slip through hole edges, etc. Also, the hook element requires a rectangular hole, but with a square hole the plug orientation can vary without problem.

The outer surface of each identical half-shell is that of a tapered, square shouldered, acme thread, The inner surface of cover 46 is the mating thread. The use of an acme thread is necessary if each half-shell is to be identical to the other, because a single helix thread will never match threads of opposing halves as a double helix thread will. The taper is to allow cover to be slid over the half-shells most of the way, until threads engage, thus saving considerable time in plug assembly. The square shoulder thread is necessary to minimize problems of thread slippage as the tapered plastic threads are loaded up, particularly during concrete placement when the rebars will inevitably be knocked around by concrete pump hoses and such. Also, the thread slope must be shallow enough to allow the plug to remain tight after impacts, et cetera.

Cover can have a ribbed surface for torsional friction to ease manual rotation. Plugs need to be screwed on quite tightly and frequently have to be unscrewed while wet. The use of square insertion holes allows the plug interior to be rotationally supported so that only the cover need be worked for plug attachment and disengagement.

Figure 14:
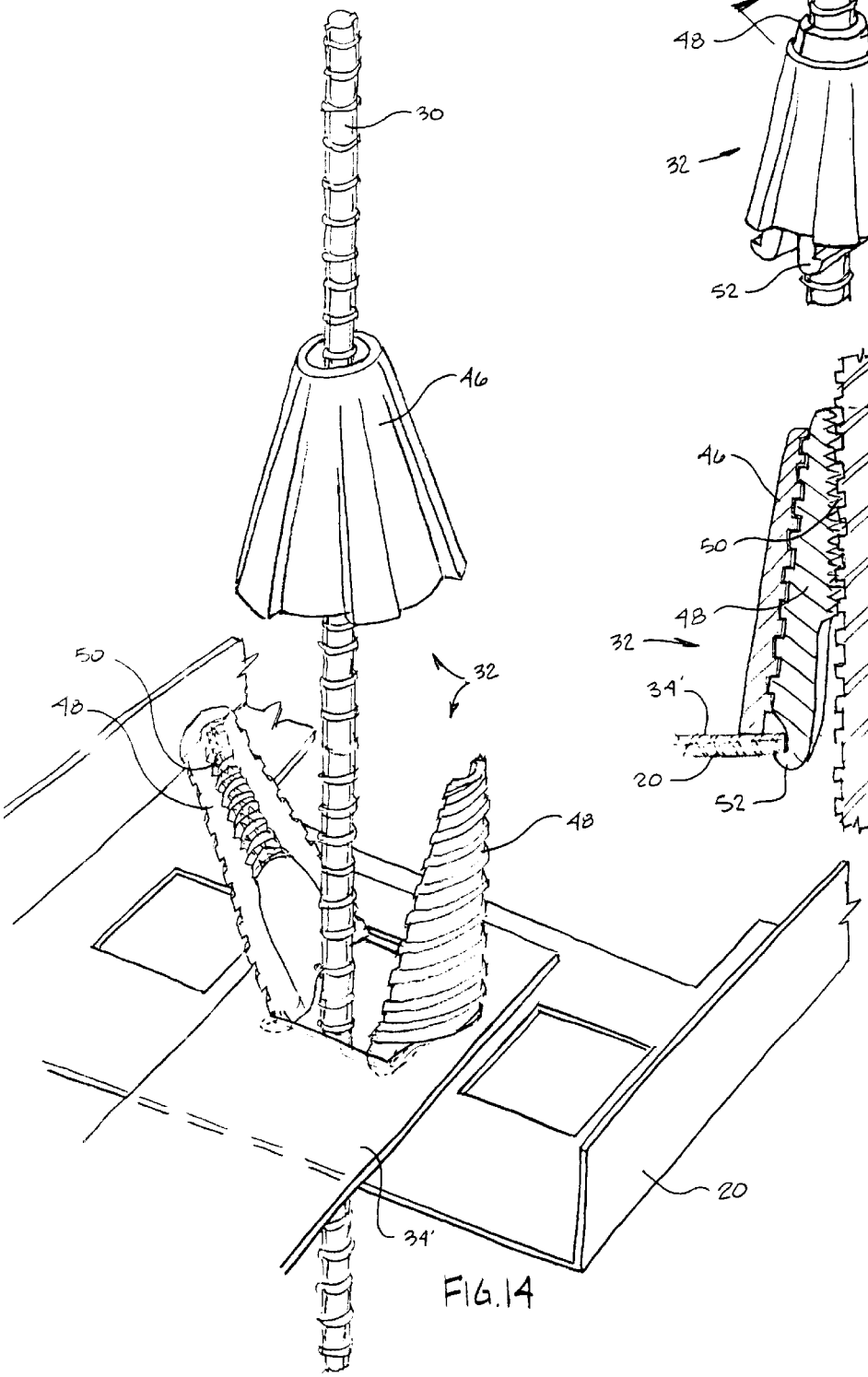
FIG. 14 is a detail view of rebar plug elements under assembly.

FIG. 14 shows plug 32 under assembly, and is described in more detail in the operation section of this invention. The mating faces of each half-shell provide essentially identical clamping action to the guide track and overlapping link 34', or other element, whether or not a rebar is within the plug.

3. Operation of the Preferred Embodiment

FIG. 1 shows the guide tracks 20 ready for concrete placement. The tracks have been initially located to align with proposed foundation walls by any conventional means, such as string lines and water levels. Once two major perpendicular wall lines have been established, assembly of contiguous tracks can continue without hesitation, checking for level for any length of track being connected. The modular spacing of the track interconnecting holes mates with the modular dimensions of the subsequent foundation wall. Thus the foundation is literally forced into being correct in the horizontal plane, which is hardly the case with conventional construction.

FIGS. 1, 3, 5, 7A and 9A: To support any length of track 20, at least two sets of stakes are typically necessary. First contiguous lengths of track are placed upon the ground approximately directly below where they will be supported. This tells the workers where the big holes will be, and so where vertical stakes 22 can be driven. Two vertical stakes are then driven through appropriate big holes, with the preferred method of driving being a high speed pneumatic 12 mm (½") square drive impact wrench with a deep hex socket. To speed up nut adjustment, a cylindrical rubber surface has been adhered about the deep socket, and is rubbed against any nut with the wrench turning at high speed. This quickly spins the nut up or down the stake.

Once the vertical stakes are driven, bottom supporting nuts are spun to the proper elevation, accounting for the thickness of the bottom clamp bar 26. The track is picked up, the bottom bars are then slid over the stakes, and the track is set down upon them. Next each upper clamp bar 26 is slid over the stake, and can be hand tightened down immediately. Or a kicker hinge can be inserted about the stake first, then the nut can be tightened down, in the case where the sloped stake would clear the edge of the track (FIGS. 3 and 5). Where the sloped stake must be higher to clear the track edge (FIGS. 7A and 9A), or in any case, the kicker hinge can be clamped separately about two additional nuts on the vertical stake (In practice, four nuts are typically kept on stakes because of this need). After the sloped stake is driven, the nuts on it can be adjusted to pull the vertical stake laterally into vertical, if adjustment is necessary (longitudinally the vertical stake can be considerably out of vertical without concern). Then the nuts about the track are loosened and the track is finely adjusted into place, if necessary.

Adjacent sections of track are interconnected with rebar plugs 32 during this process, whether or not any rebar is then inserted into them. The plugs can be undone and rebar inserted later, at the time that all the rebar is being placed, and if any rebar is being placed.

To support rebar in a rebar plug, the rebar is inserted through the square hole in the track (FIGS. 12, 13, and 14). The generous oversize of these holes allows 90 degree hooked rebars to pass through. Then as the rebar is held at the desired height with one hand, the two half-shells 48 are inserted into either side of the hole, and both are pressed against rebar, holding it in place. This rotation of the half-shells projects the bottom hooks 52 beyond the hole edges. Cover 46 is slipped offer the top of the rebar and threaded onto the half-shells. As cover is tightened, each bottom hook is pulled up to the underside of track, thus squaring up both plug and rebar.

At locations with many steps, the track pattern can begin to get out of phase with horizontal modular increments, thus horizontal checks are necessary in this case. Otherwise, closure at the last corner on the right modular increment, and a check of major diagonal dimensions is all that is necessary with the method.

Concrete is preferably placed with a pump in the method of the invention. A pump is superior to place the concrete under the guide track. Most concrete contractors would use a pump anyway for most jobs like this because of the benefit of reduced effort.

The reason pumping the concrete is preferred is the same reason the guide track works. That is, the head pressure developed below the track forces the concrete right up to its underside, pushing most air bubbles out of the way. Large areas of top surface obstruction, such as where rebar plugs may be three across, will tend to trap some air bubbles. This is actually a benefit to the finished wall strength in that the areas with obstructions align with the modular cell centers, and so act as key way elements. The large holes in guide track make up a series of locations where concrete placement can be verified, and are located to align with module edges, where support of building block products is necessary.

While placing concrete under pressure, the concrete hose end is pushed down about every third large hole until the pressure under the track pushes the hose back out. Extra care is taken to place concrete all the way up at the high end of any steps (FIG. 5).

Excess concrete left atop the guide track is screeded off of it and also back into the holes with a screeding tool. Where the track is utilized flanges up (FIG. 9A) this screeding operation requires more effort in that more concrete must be screeded because of the trough. Where either of the key way tracks (42, 44) are utilized, the clamp bar (26) locations cause more of a flaw in that concrete key way. Usually the key way flaws can be left in place without any detriment. It must be kept in mind that this excess concrete is actually pushed through the track holes, and so is easily cleared off of the track top.

At locations where miniforms are utilized (FIG. 8A), a special technique is required for forms over about 100 mm (4") in height, because of the relatively weak support against form pressure. That is, the bottom free edge of the form must be flooded about 25 mm (1") in concrete to hold it in place. Depending upon the trench confinement and concrete stiffness, the remainder of the formed void can be filled immediately, or may have to be filled about twenty minutes later after the bottom edge is securely locked in. With this method, miniforms up to about 200 mm (8") high are practical.

After concrete placement, the tracks can be stripped immediately, except at steps or where side forms are used. Since the side forming is minor, all stripping can usually occur the same day as concrete placement.

The operation described here, could be identical for creating the footings supporting many different types of walls, such as garden walls, sound walls, et cetera, which may not be part of the construction of a building.

In accordance with the preceding explanation, variations and adaptations of the foundation footing construction method and devices (particularly as serve to efficiently precisely emplace wall anchors) in accordance with the present invention will suggest themselves to a practitioner of the construction arts.

In accordance with these and other possible variations and adaptations of the present invention, the scope of the invention should be determined in accordance with the following claims, only, and not solely in accordance with that embodiment within which the invention has been taught.

What is claimed is:

1. A method of starting the construction of a wall upon the surface of the earth, the method comprising:

emplacing stakes within the earth at variable locations, each stake being variably initially so emplaced in both angle of its contact with, and in magnitude of its extension above, the surface of the earth while each stake, having once been emplaced, remains thereafter variably adjustable in both the angle of its contact with, and in magnitude of its extension above, the surface of the earth;

suspending above the surface of the earth on the stakes a fixture defining where a top surface and top edges of a footer would desirably be located;

adjusting the fixture in its three-dimensional spatial position by the simple and direct expedient of adjusting the stakes in their angles of contact with, and in their magnitudes of extension above, the surface of the earth; and placing flowable hardenable construction material upon the surface of the earth beneath and up to the underside of the suspended and positionally-adjusted fixture, therein creating when the construction material hardens a footer for a wall the top surface and top edges of which footer have been defined by the fixture.

2. The method according to claim 1 wherein the stakes are threaded into the earth, and are thus variable in the angle of their contact with, and in their extension above, when set within the earth, and are thereafter varible in their angle relative to the earth by being angularly bent, and in their extension by being screwed into or out of the earth.

3. The method according to claim 1 wherein the placing is of concrete under pressure.

4. The method according to claim 1 that, between the suspending and the placing, further comprises:

hanging a structural wall anchor element from the suspended fixture so that a portion of the anchor element extends below the fixture, and a portion of the anchor element extends above the fixture;

wherein the portion of the structural wall anchor element below the fixture becomes embedded in the footer while a wall may be anchored to the portion of the structural wall anchor element above the fixture.

5. The method according to claim 4 wherein the hanging is of a multiplicity of structural wall anchor elements, each at a spacing precisely determined by the fixture, that are suitable to subsequently affix to the footer a structural wall that is suitably so affixed and anchored by (i) the wall anchor elements (ii) at the precise spacing.

6. The method according to claim 5 where the hanging of the multiplicity of structural wall anchor elements is at a spacing suitable to subsequently affix a structural wall drawn from the group consisting of:

a foundation wall;

a sound wall;

a privacy wall;

a building wall;

a garden wall; and a retaining wall.

7. The method according to claim 5 where the hanging of the multiplicity of structural wall anchor elements is at a spacing suitable to subsequently affix a structural wall made from the group of building materials consisting of:

cement masonry units including concrete blocks;

foam building blocks; and welded wire mesh panels.

8. A method of starting the construction of a wall upon the surface of the earth, the method comprising:

suspending above the surface of the earth a fixture defining where a top surface and top edges of a footer would desirably be located on supporting members that are (i) readily variably located upon the surface of the earth relative to the fixture that they serve to support, the size and the shape of the fixture defining the approximate locations of supporting members required to suspend the fixture, (ii) of sufficient strength and rigidity so as to collectively serve to hold the fixture stably in its suspended position, while being (iii) sufficiently adjustable in both their extension above the surface of the earth, and in their angles relative to the surface of the earth, so as to readily permit adjustment of the three dimensional spatial position of the suspended fixture, and (iv) at least in part paired as a substantially vertical member intersected above the surface of the earth by another member oriented angularly obliquely to the surface of the earth so that the oblique member may force as desired a tilt of the substantially vertical member; then adjusting in three-dimensional spatial position the suspended fixture, itself making no contact with the earth, save through the supporting members, by the simple and direct expedient of (1) judiciously flexibly placing the supporting members in positions where they best adjust a coarse spatial position of the suspended fixture, and then (2) judiciously flexibly adjusting as required any of the supporting members in (2a) their extensions above the surface of the earth and in (2b) their angles relative to the surface of the earth; and then placing flowable hardenable construction material upon the surface of the earth beneath and up to the underside of the suspended and positionally-adjusted fixture, therein creating when the construction material hardens a footer for a wall the top surface and top edges of which footer have been defined by the fixture.

9. The method according to claim 8 wherein the suspending comprises:

holding aloft the fixture with stakes driven into the earth;

wherein the stakes are adjustable in their extensions above the surface of the earth by the simple expedient of controlling how far the stakes are driven into the earth; and wherein the stakes are adjustable in their angles relative to the surface of the earth by the simple expedient of slightly deforming the stakes by bending.

10. The method according to claim 9 wherein the stakes have and define external threads, and are threaded as well as driven into the earth;

wherein the threaded stakes are additionally, also, adjustable in their extension above the surface of the earth by the simple expedient of being threaded into the earth to a variable extent.

11. The method according to claim 8 that, between the suspending and the placing, further comprises:

hanging a structural wall anchor element from the suspended and positionally-adjusted fixture so that a portion of the anchor element extends below the fixture, and a portion of the anchor element extends above the fixture;

wherein the portion of the structural wall anchor element below the fixture becomes embedded in the footer while a wall may be anchored to the portion of the structural wall anchor element above the fixture.

12. The method according to claim 11 wherein the hanging is of a multiplicity of structural wall anchor elements, each at a spacing precisely determined by the fixture, that are suitable to subsequently affix to the footer a structural wall that is suitably so affixed and anchored by (i) the wall anchor elements (ii) at the precise spacing.

13. The method according to claim 12 where the hanging of the multiplicity of structural wall anchor elements is at a spacing suitable to subsequently affix a structural wall drawn from the group consisting of:

a foundation wall;

a sound wall;

a privacy wall;

a building wall;

a garden wall; and a retaining wall.

14. The method according to claim 12 where the hanging of the multiplicity of structural wall anchor elements is at a spacing suitable to subsequently affix a structural wall made from the group of building materials consisting of:

cement masonry units including concrete blocks;

foam building blocks; and welded wire mesh panels.

15. A method of constructing a foundation footing comprising:

suspending level above the surface of the earth in the rough outline of a foundation a multiplicity of elongate linear guide members each with a flat upper surface having and defining an arrayed multiplicity of holes at a precise spacing both along the linear extent of the member and transverse to this extent, and side flanges, wherein the guide members are suitably both (i) overlapped at their end regions to extend straight for a greater distance than is a length of a single member, and (ii) abutted at right angles where a foundation corner is desired to be located;

placing elongate linear spanning members, relatively much shorter than are the guide members and having arrayed holes of equal size and on equal dimensions as are the holes of the guide members, in positions overlying abutting guide members;

precision-aligning the multiplicity of guide members and spanning members in their suspended state by placing plugs within at least some of the arrayed multiplicity of holes in the regions of overlap between guide members and spanning members, and between guide members and spanning members, therein to bring all linear dimensions of all suspended members into tight dimensional tolerance in accordance with the precision of the spacing of the holes;

truing the precision-aligned guide and spanning members to right angles, therein to make sure that the suspended members that are in tight dimensional tolerance in the outline of a foundation are also in precise relative locations and angular relationships;

placing flowable building material beneath the suspended precision-aligned trued guide and spanning members to produce when hardened a footer; and stripping from off the footer at least some of the guide members and the spacing members and the plugs for re-use.

16. The method of constructing a foundation footing according to claim 15 wherein the precision-aligning of the multiplicity of guide members and spanning members in their suspended state by the placing of plugs within at least some of the arrayed multiplicity of holes further comprises:

placing vertical lengths of rebar members within a hollow central bore of the plugs as such plugs are inserted within at least some of the arrayed multiplicity of holes, the plugs thereafter serving to compressively hold the rebar to the guide members and to the spanning members to which the plugs are affixed, and, like as to these guide members and spanning members themselves, suspended above the surface of the earth;

wherein each vertical rebar member becomes precisely located both along the linear extent of the member and transverse to this extent in accordance with the precision spacing of the holes, and precisely located above the surface of the earth in accordance that it is compressively held suspended by the inserted plug.

17. The method of constructing a foundation footing according to claim 16 wherein the placing of the vertical lengths of rebar members compressively within a hollow central bore of the plugs is facilitated in that the plugs come in two halves, and the placing more particularly comprises:

inserting the base of the two halves of the plug within a hole while an upper region of the plug remains temporarily spread so as to receive a rebar member; and closing the two halves so as to compressively hold the rebar member.

18. The method of constructing a foundation footing according to claim 17 that, after the closing, further comprises:

placing a cover about the two halves of the plug in order that they may be held in compression about the rebar member.

* * * * *